United States Patent [19]

Santini

[11] Patent Number: 4,732,400

[45] Date of Patent: Mar. 22, 1988

[54] SCOOTER BOARD

[76] Inventor: Luis A. Santini, Condominio Las Torres Sur-3F, Bayamon, P.R. 00619

[21] Appl. No.: 867,160

[22] Filed: May 27, 1986

[51] Int. Cl.[4] ..... A63C 17/02

[52] U.S. Cl. ..... 280/87.04 A; D21/227

[58] Field of Search ..... 280/87.04 R, 87.04 A, 280/11.19; 272/70.3, 114, 146; 446/279, 281; D21/227, 224

[56] References Cited

U.S. PATENT DOCUMENTS

| | | | |
|---|---|---|---|
| D. 199,682 | 12/1964 | Jezowski | 280/87.04 R |
| D. 200,864 | 4/1965 | De Roco | D21/227 |
| D. 218,628 | 9/1970 | Gonzalez | D21/227 |
| D. 242,735 | 12/1976 | Candler | D21/227 |
| D. 261,022 | 9/1981 | Hoskins | D21/227 |
| 1,070,468 | 8/1913 | Henley | 280/87.04 A |
| 1,138,263 | 5/1915 | Tutt | 280/87.04 R |
| 1,150,773 | 8/1915 | La Chall | 280/87.04 A |
| 1,239,196 | 9/1917 | Lundquist | 280/87.04 R |
| 1,445,219 | 2/1923 | Larson | 280/7.12 |
| 1,617,337 | 2/1927 | Lees | 280/87.04 R |
| 2,062,800 | 12/1936 | Shreffler | 280/87.04 A |
| 2,170,616 | 8/1939 | Gorton | 280/87.03 |
| 2,330,147 | 9/1943 | Rodriguez | 280/87.04 R |
| 2,366,866 | 1/1945 | Moller | 280/87.04 R |
| 3,197,227 | 7/1965 | Anselmo | 280/87.04 A |
| 4,182,520 | 1/1980 | Stevenson | 280/87.04 A |
| 4,323,261 | 4/1982 | Samuelson | 280/87.04 A |
| 4,337,963 | 7/1982 | Stevenson | 280/87.04 A |
| 4,385,761 | 5/1983 | Rice | 272/146 |

*Primary Examiner*—John J. Love
*Assistant Examiner*—Eric Culbreth
*Attorney, Agent, or Firm*—Joseph Chalverus

[57] ABSTRACT

A skateboard-type vehicle of wide dimensions features a centrally located, weight supporting upright with laterally pointing handles. The height of the upright is adjustable and the platform is reinforced and has an edge protector. The novel features enable a user to control the direction of the board with the handles, to straddle in an eagle-like fashion upon the upright and to perform jumps with the skateboard.

10 Claims, 9 Drawing Figures

SCOOTER BOARD

BACKGROUND OF THE INVENTION

The present invention relates generally to skateboards, and more particularly to skateboards of wide dimension having a centrally located, weight supporting vertical upright with handles.

Scooters are known in the prior art to include generally a vehicle with a low, narrow foot board or platform having one or a pair of matching wheels attached near each end of the platform underneath, featuring handles attached to a vertical post positioned onto the front end of the platform. The rider, while holding onto the handles and placing one foot upon the platform propels himself and the scooter forward by a series of pushes made by the other foot against the ground. Coasting is accomplished by placing both feet upon the board, one foot forward the other while the scooter is in motion. Steering is accomplished by tilting the vertical upright toward the side the rider wishes to turn.

Skateboards are also known in the prior art to include generally a platform having two sets of spaced wheel pairs, each wheel pair centrally mounted on a wheel assembly with a resilient coupling underneath an end of the platform. The wheel assemblies are mounted underneath, near the ends of the platform.

Each wheel pair in a skateboard is generally joined by an axle having a forwardly and upwardly inclined pivot member fitted into a mating cup on the attachment means to the platform. This arrangement permits the axle to turn according to the tilt in the platform.

The wheels of each pair are parallelly mounted and separated from each other characteristically by three to five inches. The wheels have generally rounded sides and are made of low rolling friction material and ride on low friction bearings. The low friction wheels and bearings permit the skateboard to go very fast and long distances. The rider often propels himself and the skateboard forward by a series of pushes made by one foot against the ground while balancing himself with the other foot on the skateboard. Coasting is accomplished by placing one foot forward of the other on the skateboard in a surfboard fashion while the vehicle is in motion. Steering is accomplished by the rider tilting the platform or biasing his weight onto the right side of the board to steer towards the right and onto the left side of the board to steer towards the left.

These abilities of the skateboard have attracted the interest of children and adults thereby making the skateboard a popular toy, athletic device and is frequently used in competitive events.

SUMMARY OF THE INVENTION

My invention incorporates the concept of the skateboard with its low friction bearings and rounded wheels flexibly attached through a wheel assembly to the underside ends of a platform with steering pivot means and the concept of the scooter with handles on a vertical post modified according to the following: a vertical post with handles is height adjustable and lockable and generally centrally positioned between the ends and sides of the platform. The width of the platform is approximately double that of a normal skateboard. In addition, the distance between the wheels of each pair approximates about seven inches. The platform is strengthened and made rigid and a protector strip is placed along the platform's edges. These modifications permit the user to place both his feet parallelly, one on each side of the centerline of the board, while holding onto the handles. In this way, the rider can more easily control his balance while on the board and can steer the board either by biasing the weight of the board or by tilting the vertical post toward the side of the board the rider wishes to steer towards.

The location of the vertical post, generally at the center, permits the user to lift the entire platform into the air while riding upon it. The rider grasps the handles firmly and while standing upon the platform with relaxed knees quickly pulls the handles in an upward motion. This may be performed while the rider is in motion or not in motion. When in motion, this could be used for distance jumping or height jumping contests. The centrally located vertical post also permits the user to perform other stunts not possible with the skateboard; for example, a stunt such as balancing in a spread-eagle fashion, with the arms and legs extended while the rider is supported near the pelvic region upon the handles. Because the platform must withstand an appreciable amount of stress, the present invention also contemplates a strong, rigid platform made of one-quarter to three-eighth inch steel plate reinforced underneath by strips of iron flanges welded into a double "H" framework. The lateral strips of the framework are located underneath the foot placements while the transverse strips fall approximately between the center and the edge of the front. The edge of the platform is covered with a protector strip to absorb any of the impacts the platform may suffer. The present invention, therefore, improves the stability, strength, and safety of this type of vehicle. These improvements enable this vehicle to be used for the stunts described as well as other stunts which would be obvious to a person familiar with the use of this type of vehicle. The center post with handles can be conveniently removed to permit the user to use the platform as a very wide and very strong skateboard and to facilitate transportation and storage.

Since the new scooter board is stronger, safer and easier to use than the conventional skateboard or scooter, an object of my invention is to provide a skateboard-type vehicle which features a ready means to control the rider's balance thereupon.

An additional object of my invention is to provide a skateboard-type vehicle which can be accurately controlled by the user's hands.

Another object of my invention is to provide a skateboard-type vehicle with a means to control steerage by the riders'hands.

A further object of my invention is to increase the stability of the skateboard-type vehicle by substantially increasing the width of the board, providing space for both feet to be placed parallelly.

An additional object of my invention is to increase the stability of the skateboard-type vehicle by increasing the distance between the wheels of each matching pair.

Yet another object of my invention is to provide a means to lift the vehicle off the ground while the rider is in place.

Yet a further object of my invention is to provide a skateboard-type vehicle with a centrally located vertical upright with handles for balancing the rider thereupon.

A further object of my invention is to increase structural strength of a skateboard-type vehicle with a centrally located upright with handles.

Other objects and advantages of my invention will be apparent from a consideration of the following detailed description taken in connection with the accompanying drawings wherein certain methods of installations for practicing the invention are illustrated. However, it is to be understood that the invention is not limited to the details disclosed, but includes all such variations and modifications as fall within the spirit of the invention and the scope of the appended claims.

DETAILED DESCRIPTION OF THE PREFERRED EMBODIMENT

Figure 2:
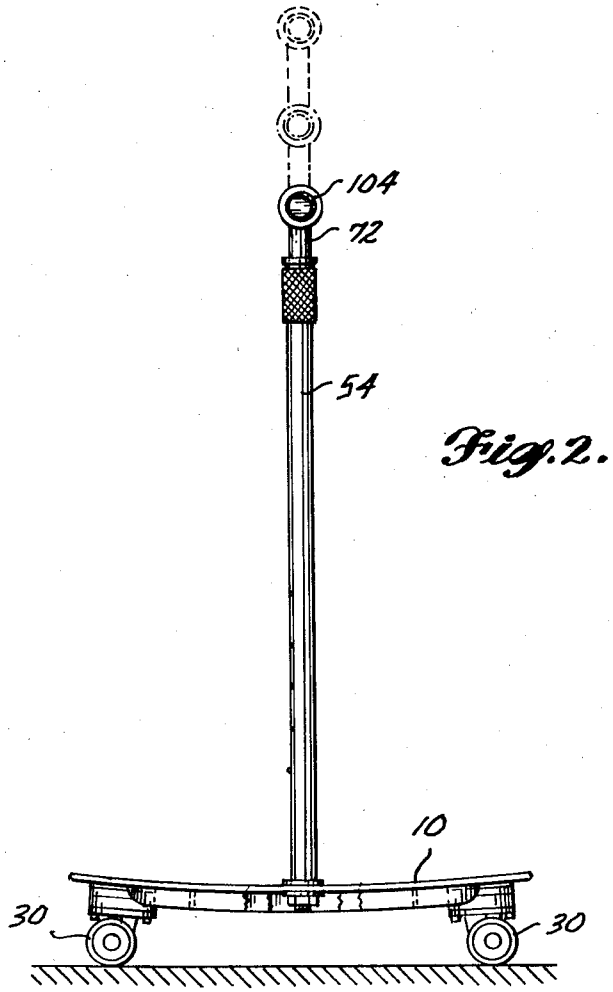
FIG. 2 is a side elevational view of the scooter board.
Figure 1:
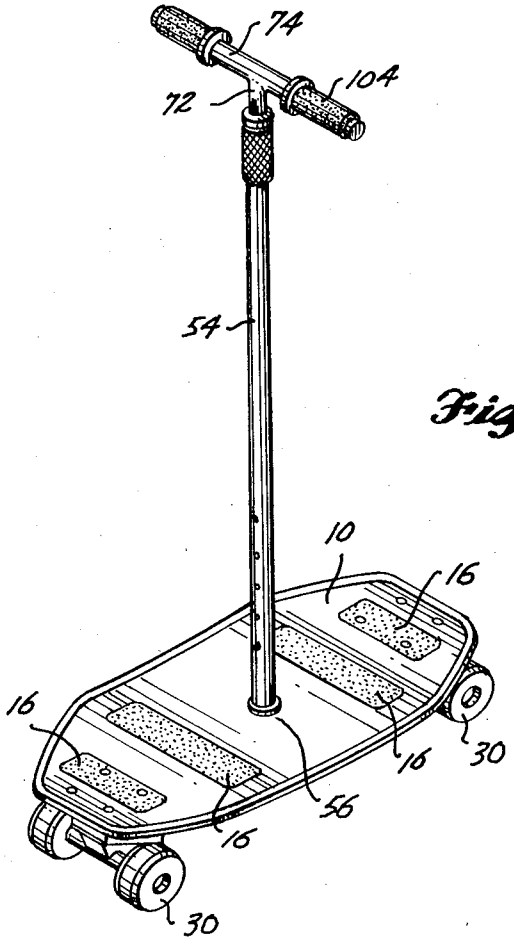
FIG. 1 is a perspective view of the scooter board.
Figure 4:
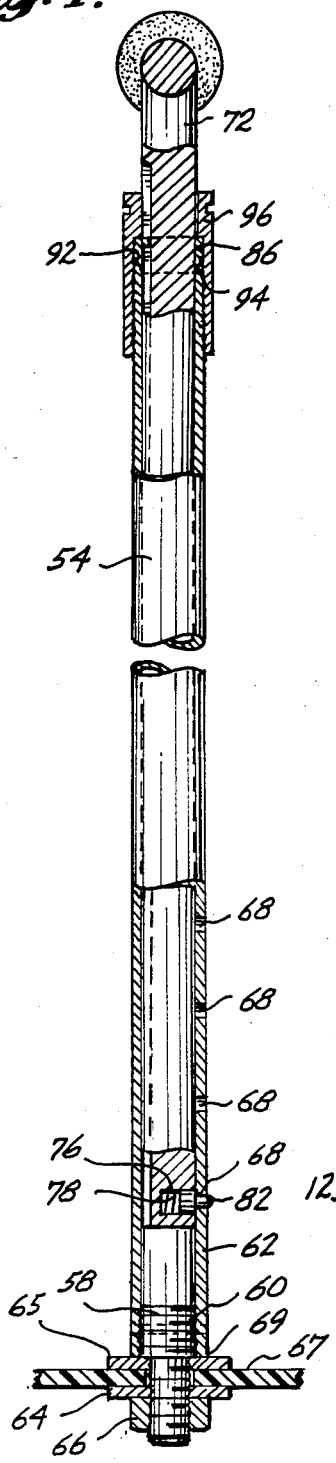
FIG. 4 is a cross sectional view of the upright centrally located post on the scooter board.
Figure 5:
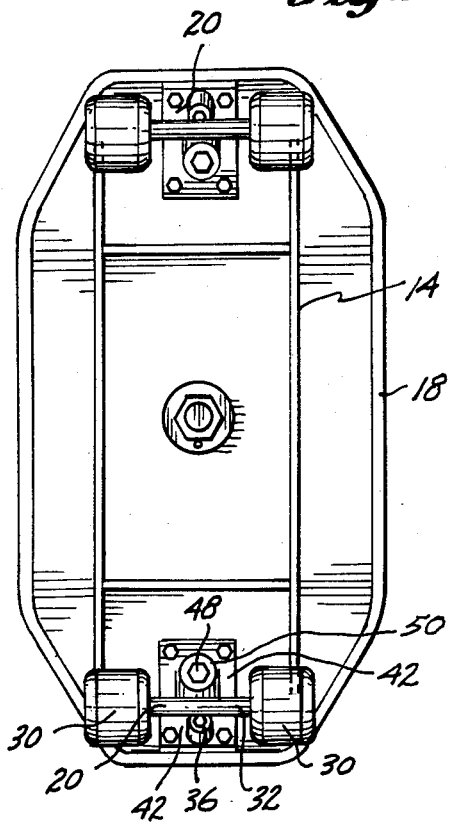
FIG. 5 is a plan bottom view of the scooter board.
Figure 3:
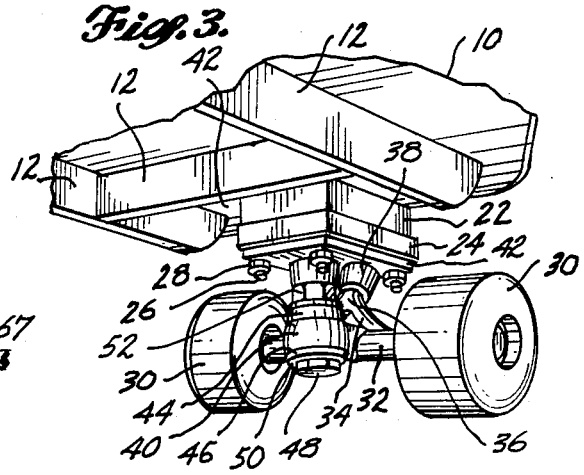
FIG. 3 is an expanded perspective view of a wheel pair assembly related to the underside of the scooter board.

Referring now to the diagrams, a skateboard-type vehicle generally shown in FIG. 1 has a steel platform 10, having a substantially rectangular shape with its corners removed. The steel platform 10 is cut from a one-quarter to three-eighth inch thick stock steel sheeting. The platform 10 is reinforced underneath by means of several steel supporting rectangular strips 12 also cut from a one-quarter inch to three-eighth inch stock steel sheeting and welded perpendicularly to the platform in a double "H" joist framework 14. Friction strips 16 attached to the upper surface of the platform assure good contact between the user's shoes and the platform 10. A shock absorbing protector strip 18 is placed along the entire edge of the platform 10 to protect the platform 10 as well as any objects with which the platform 10 may impact.

As with other skateboard-type vehicles, the platform 10 rides upon two identical wheel pair assemblies, each shown generally as 20. Each wheel pair assembly 20 is fastened through a mounting structure containing a riser 22, and shock absorbing pad 24 to an end of the underneath side of the platform 10 with four stove-type bolts 26 and matching nuts 28.

The riser 22 can be made of any conveniently stiff material and is used to prevent the platform 10 or reinforcement framework from contacting a wheel 30 or the wheel assembly 20. The shock absorbing pad 24 can be made of any resilient material such as hard rubber and is used to absorb and distribute stresses which may be produced when the vehicle is in use.

Each wheel assembly 20 has an axle 32 with the reinforcement structure 34 joining the two identical wide wheels 30 at their extremities, through low friction bearings (not shown). Each wheel 30 is shaped as the typical skateboard wheel: wide with round sides and cast of low rolling friction material.

The forwardly inclined pivotal member 36 extends into a steering cavity receptacle 38 molded into the forward part of the wheel assembly base 42. The forwardly inclined pivotal member 36 helps support the platform upon the wheel assembly while being free to turn within the steering cavity receptacle 38.

The supporting ring 40 is mounted above the center of the assembly base 42 with a resilient supporting structure containing two grommets 44 and 46, which sandwich the supporting ring 40 and bolt 48, washer 50, and hexagonal nut 52. The resilient supporting structure firmly attaches the supporting ring 40 to the assembly base 42. The grommets 44 and 46 permit the axle 32 with reinforcement structure 34 and supporting ring 40 to move relative to the assembly base 42. The washer 50 protects the lower grommet 46 from the hexagonal nut 52.

The forwardly inclined pivotal member 36, steaerng cavity receptacle 38 and resilient supporting structure align the axle 32 with wheels such that the platform will travel in a straight-forward direction whenever the platform 10 is horizontal. However, when one of the sides of the platform 10 is tilted downwards or biased towards one of the sides, the forwardly inclined pivotal member 36 is urged to turn within the cavity receptacle 38 to the direction of the bias forcing the wheel pair to turn into the direction of the bias. The resilient supporting structure provides the support between the supporting ring 40 and the wheel assembly base 42 for a turning movement. The turning movement is approximately proportional to the amount the platform is biased.

The wheels 30 of each wheel pair are separated from each other by approximately seven inches. The extended distance between the wheel pairs enhances the stability of this vehicle.

A weight supporting, height adjustable and removable vertical upright assembly 54 is centrally attached to the platform 10 at the center of the platform 56. The height adjustable feature for the upright 54 enables users of various statures to change the relative configuration of the vehicle. The removable feature enables the user to configure the vehicle into a skateboard which is very wide, and because of reinforcement, very strong.

An interior, threaded plug 58 attaches internally threaded portions 60 of the bottom end of a sleeve 62 through a hole drilled through the center of the platform at 56. The plug 58 is locked at the underneath side of the platform with a washer 64 and matching threaded nut 66. Another washer 65 separates the top surface 67 of the platform from the bottom end 69 of the sleeve. The sleeve 62 has numerous forwardly oriented apertures 68 spaced vertically along a section. The top exterior portion 70 of the sleeve is threaded while the interior of the top portion of the sleeve is beveled.

A rod 72 with oppositely pointing side handles 74 welded to the top of the rod 72 in a "T" shape is dimensioned to snugly fit into the interior of the sleeve 62. A forwardly oriented radial cavity 76, drilled near a portion of the bottom of the rod contains a compression spring 78, which urges a bullet-shaped plunger 80 with a round emergent end 82 from the cavity 76. The round emergent end 82 is dimensioned so that the emergent end 82 extends through one of the forward apertures 68 on the sleeve, thereby locking the relative positions of the rod 72 within the sleeve 62.

Figure 6:
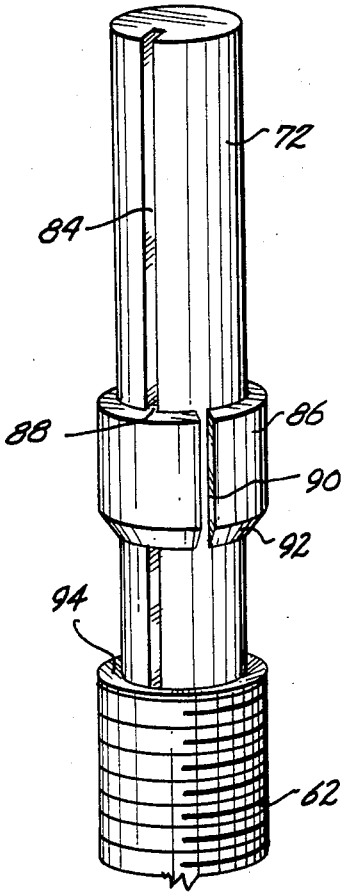
FIG. 6 is an expanded view of the post and top portion of the sleeve.
Figure 7:
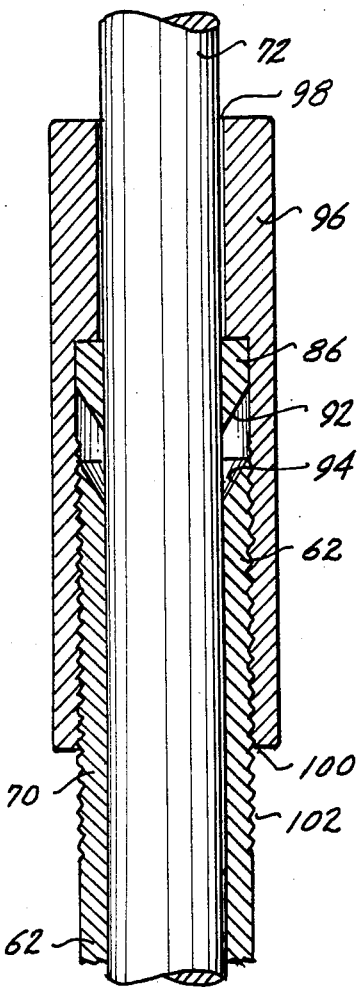
FIG. 7 is a cross sectional view of the post, sleeve, and tubular tightener.

Referring to FIGS. 6 and 7, a vertical channel 84 cut along the rearward portion of the rod 72, aligns a circular compression structure 86 having a key stem 88, a gap 90, and its bottom portion inwardly beveled 92 to match the outwardly beveled portion 94 of the top of the sleeve 62. The circular compression structure 86 lies upon the top of the beveled sleeve portion 94 and is dimensioned to snugly fit about the rod 72. The key stem 88, fit into the channel 84 prevents the circular compression structure 86 from turning about the rod 72.

A tubular tightener 96 with a top orifice 98 dimensioned for the diameter of the rod 72, has the bottom orifice internally threaded 100 to match the exterior threads 102 of the top portion of the sleeve 62.

The rod 72 fits through the top orifice 98 of the tubular tightener 96, and through the keyed circular compression structure 86. The rod height is then adjusted to the desired level. The round emergent end of the plunger 82 may emerge through an aperture 68 locking the height of the rod 72 at a spaced interval. The tubular tightener 96 is threaded down upon the sleeve 62 urging the compression structure 86 into the sleeve. The matching beveled portions of the compression structure 86 close about the rod 72 thereby locking the rod 72 at an desired height relative to the sleeve 62.

Resilient coverings 104 on the handles 74 provide a frictional, secure grasping surface for the user's hands.

Figure 9:
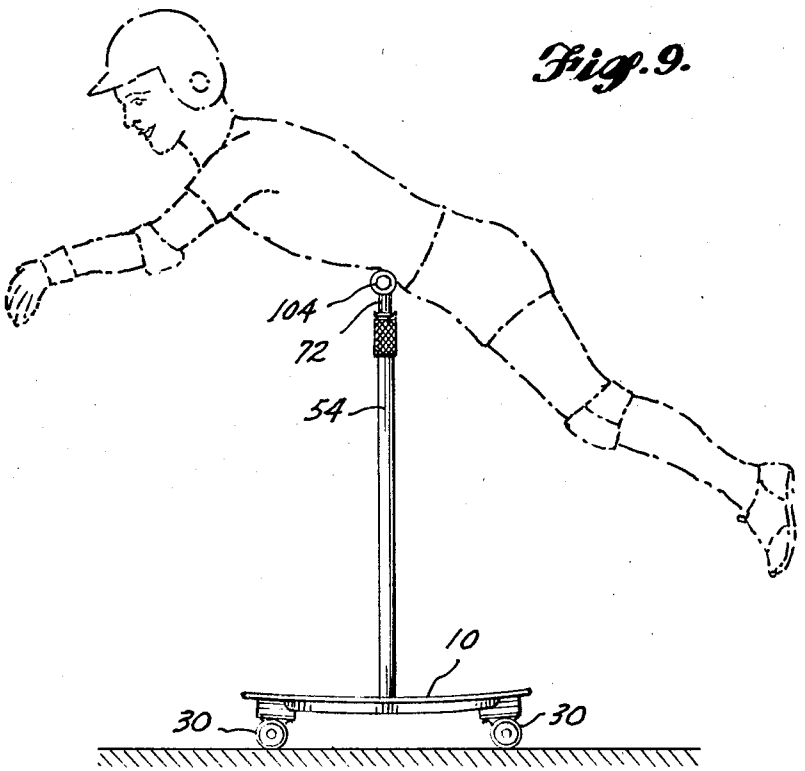
FIG. 9 is a side view of my scooter board with a user balancing himself thereupon.
Figure 8:
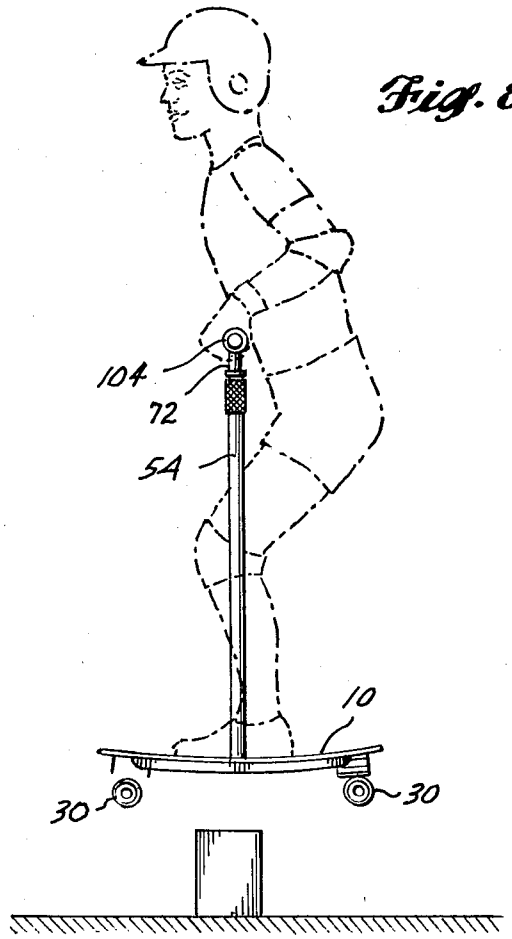
FIG. 8 is a side view of my scooter board with a user jumping over an arbitrary object.

The unique features of my scooter board enable the user to perform a variety of stunts heretofore not possible. FIG. 8 demonstrates the scooter board and user in a jumping mode. The scooter board can either be still or moving while the user straddles the vertical upright with both feet on the board; while relaxing his knees and grasping the handles the user pulls upward. The height of the jump will depend upon the skill and strength of the user. FIG. 9 demonstrates a user straddling himself in an eagle-like fashion upon the handles of the scooter board. It is obvious that the scooter board can either be still or in motion. These and many other stunts are now possible. While I have described two stunts which can be performed on the scooter board, it is obvious that a variety of other stunts can now be performed limited only by the skill, strength and imagination of the user.

I claim:

1. A skateboard-type vehicle having a platform, a frictional top surface, two sets of wheel pairs, an axle joining each wheel pair, each wheel cast with rounded sides of material offering low rolling resistance, each wheel pair attached for forwardly rolling near an end of an underside of the platform through an inclined pivotal and resilient coupling structure capable of turning the wheel pair into the direction of the platform's tilt comprising:

a reinforcement means for said platform;

a weight supporting vertical upright;

attachment means to rigidly attach said vertical upright through the center of the platform;

a transversely extending T-shaped handle assembly adjustably secured to the top of the vertical upright;

the platform's width accommodating a user's feet placed together upon the platform with a foot placed on each side of the vertical upright, said upright further comprising a means to adjust and lock the height of said upright.

2. A skateboard-type vehicle as described in claim 1 in which said reinforcement means for said platform comprises steel plate one quarter to three-eighth inch thick; and a joist framework of steel supporting members welded to the underside of said platform.

3. The skateboard-type vehicle as described in claim 1 further comprising hand grippers attached around said handles.

4. The skateboard-type vehicle as described in claim 1 further comprising a protector srip of shock absorbing material placed around the edge of said platform.

5. The skateboard-type vehicle as described in claim 1 wherein said attachment means further includes a means to disengage said upright from said platform.

6. An improved skateboard vehicle having a platform, a frictional top surface, two sets of wheel pairs, an axle joining each wheel pair, each wheel cast with rounded sides of material offering low rolling resistance, each wheel pair centrally attached for forwardly rolling near an end of an underside of the platform through an inclined pivotal and resilient coupling structure capable of turning the wheel pair onto the direction of the platform's tilt, the improvement comprising:

a reinforcement means for said platform;

a weight supporting vertical upright;

attachment means to rigidly attach said vertical upright through the center of the platform;

a transversely extending T-shaped handle assembly adjustably secured to the top of said vertical upright;

the platform's width accommodating user's feet placed together upon the platform with a foot on each side of the upright, said upright further comprising a means to adjust and lock the height of said upright.

7. An improved skateboard-type vehicle as described in claim 6 in which said reinforcement means for said the platform comprises steel plate about one quarter to three-eighth inch thick; and a joist framework of steel supporting members welded to the underside of said platform.

8. An improved skateboard-type vehicle as described in claim 7 further comprising handle grippers attached around the handles.

9. An improved skateboard-type vehicle as described in claim 8 further comprising a protector strip of shock absorbing material placed around the edge of said platform.

10. An improved skateboard-type vehicle as described in claim 6 wherein said attachment means further includes a means to disengage said upright from said platform.

* * * * *